United States Patent [19]

Benzan

[11] 3,938,932

[45] Feb. 17, 1976

[54] PROCESS FOR IMPROVING THE COMBUSTION OF SOLID

[76] Inventor: Luciano Benzan, c/o Busenco Establishment, Via Ortona 5, 47036 Riccione (Forli), Italy

[22] Filed: Feb. 4, 1974

[21] Appl. No.: 439,019

[52] U.S. Cl. ..... 431/2; 239/4; 239/102; 431/89

[51] Int. Cl.[2] ..... F23D 21/00

[58] Field of Search ..... 431/1, 2, 89, DIG. 9; 239/102, 4; 137/685

[56] References Cited

UNITED STATES PATENTS

| | | | |
|---|---|---|---|
| 1,992,938 | 3/1935 | Chambers et al. | 431/DIG. 9 |
| 2,908,443 | 10/1959 | Fruengel | 431/DIG. 9 |
| 3,039,699 | 6/1962 | Allen | 431/1 X |
| 3,200,873 | 8/1965 | Young et al. | 239/102 X |
| 3,400,892 | 9/1968 | Ensminger | 239/102 |
| 3,795,475 | 3/1974 | Hellstrom | 431/1 |

*Primary Examiner*—Edward G. Favors
*Attorney, Agent, or Firm*—Michael J. Striker

[57] ABSTRACT

An improved process for the combustion of solid, liquid or gaseous substances in association with a combustion supporter, wherein upstream of the burner and at least on one of the fuel and combustion supporter flow-pipes there is applied at least a source of pulses and energy fields.

11 Claims, 9 Drawing Figures

3
2

3
5
2

2
3
5
2
3

FIG. 4
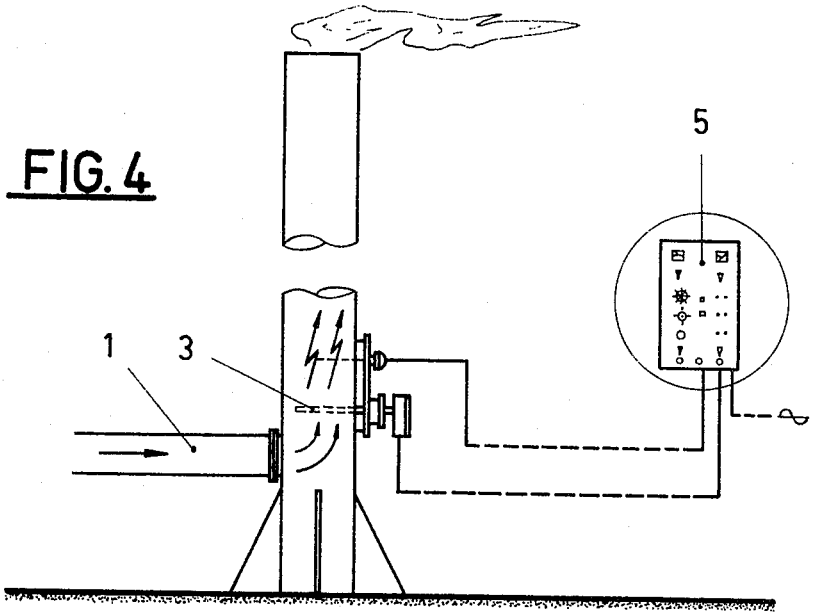
FIG. 5
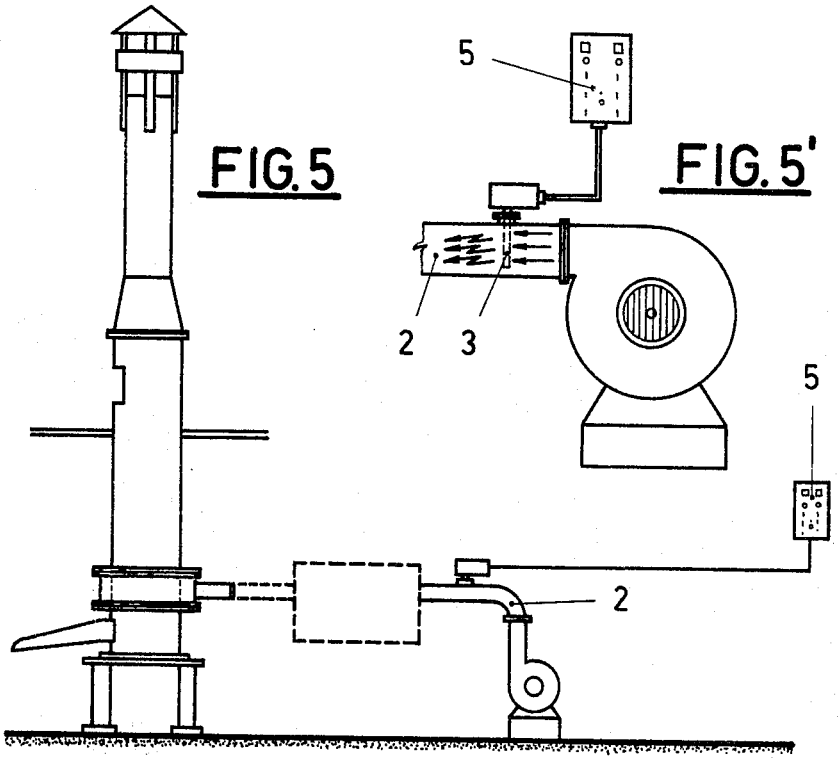
FIG. 5'

PROCESS FOR IMPROVING THE COMBUSTION OF SOLID

This invention relates to a process, adapted to ensure the improvement of combustion of solid, liquid and gaseous substances.

Also the devices, permitting to put said process into effect, and their particular placement in the structure of the various combustion systems, constitute an integral part of the present invention.

As well known, the combustion phenomenon consists, essentially, of a strong combination between a combustible and a combustion supporter substance with a consequent development of light and heat.

Said phenomenon develops more fully when the mixing of the combustible medium with the combustion supporter substance occurs more closely. Said mixing is, however, obtained at present still in a rough manner due to the existence of a molecular tension between the various particles, in general. In the case of liquid fuels, the presence of surface tension prevents a fine crushing of the individual droplets.

The above-mentioned facts explain the imperfect combustion of the solid, liquid and gaseous substances, which results in the formation of harmful or corrosive compounds. These compounds are generally of a harmful nature from both an ecological standpoint and maintenance and proper operation of the systems.

It should be noted here in fact that in the combustion systems as used at the present time the stoichiometric combination conditions are never complied with.

Consequently, it is necessary to provide the systems themselves with an excess of combustion supporting air, which, besides increasing the volume proper of combustion gases, subtracts heat and reduces the flame radiating power.

A bad combustion results further in the formation of highly harmful compounds, such as carbonic oxide, and may provoke for the outlined reasons oxidation phenomena affecting the materials coming into contact with exhaust gases.

All the aforementioned inconveniences are instead removed by the preliminary treatment, namely before the combustion of the combustible and/or combustion supporter substances according to the process of this invention. Said process is based in practice on the application to the pipings connected upstream on the burner of pulses and energy fields, acting on the gases and/or liquids, cooperating with the combustion phenomenon before the latter reach their combination and combustion.

The aforesaid energetic fields may be obtained both by ultra-sound generators and by resorting to other energy forms, such as magnetism, electrical currents, microwaves, laser rays and the like.

In particular, in the following detailed description, reference will be made by way of non-limiting example only to the application of ultra-sound sources and typical combustion systems, with the possibility still remaining may be replaced said sources by other energy sources, such as those referred to above.

According to the present exemplification, the ultrasounds are emitted by one or more transducers, piezoelectric, magnetostrictive or electrostrictive transducers, or electrodynamic or electrostatic transducers or even by mechanical energy supplied generators. The number of said ultra-sound generators depends, of course, on the deliveries of the individual ducts, and hence, on the unit quantities of gas or liquid to be treated. The pulses and the ultrasonic energy are sent perpendicular or coaxial to said ducts.

More accurately, in the case of gas, the energy emitter is inserted via a sheath, consisting of tube, or blade or grid, into the fluid vein, thereby causing the cavitation phenomenon. In the case of liquids, the energy is sent perpendicularly to the duct via a special resonance block, consisting of highly pure aluminium.

In this second case, in order to exploit the cavitation phenomenon and to accentuate and amplify the energy put into the flow of the liquid, there is provided at a point being downstream of the signal application place, a variation of the flow itself.

Said variation is attained, in practice, by either contracting or enlarging the section of the duct into which the liquid flows.

It should be stated here that said turbulence phenomenon may be provoked for the same purposes also in the aeroform transporting ducts. To the process of this invention may be submitted, as the case may be, both the combustion supporter consisting generally of air and either the liquid or gaseous fuel.

In the case of solid fuel or pulverized fuel, it is preferred that the treatment with ultra-sounds or other energy forms be carried out on the combustion supporting air.

Should results of particular effect be obtained, the instant process may be simultaneously applied both to combustible and combustion supporter substances upstream of or before the place or at the time when the combustion takes place. In such case, the energetic emission of the sources is regulated via a special central pilot control processes the data supplied by thermocouples being suitably located along the ducts.

The process according to the present invention may be applied in practice to all systems using solid, liquid or gaseous, fuels, such as boilers, industrial furnaces, refinery torches, thermic motors, and the like.

Without restricting the protection and scope of the present invention, it should be noted that the application of pulses and energy fields to the fuel, the combustion supporter, or to both, according to the process of this invention, acts on the molecules of the substances handled, producing an activation thereof of a chemical or chemical-physical nature.

It is thought in the fact, and this explanation is to be understood in non-limiting sense, that the applied pulses act on the molecular tension in the case of gaseous substances and on the surface tension in the case of liquid substances, bringing about a molecular activation of a chemical-physical nature of the substances themselves.

Therefore, the activation obtained according to the process of this invention is most different from that obtained from the mechanical crushing means as generally well known, said crushing being of a mechanical character only.

Said activation of the fuel or combustion supporter or of both, obtained from the process according to the present invention permits to obtain a reduction of both the excess combustion supporting air and the quantity of oxygen being present in the burnt gases.

It is possible to notice further in the combustion products a marked percentage decrease of hydrogen, carbonic oxide, sulfurous acid and sulphur trioxide.

By the process of this invention it is possible to obtain also a sharp reduction of fumes, soot, aerosol from hydrocarbons, unburnt solid products and the like, whereas the combustion systems are less subjected to corrosion phenomena due to vanadium pentoxide.

It should be stressed here finally that in view of the better properties of burnt gases, there occurs a reduction of both the oxidation and decarburization phenomenon on the materials coming into contact with the burnt gases themselves.

These and further characteristic features of the process according to the present invention, adapted to ensure an improved combustion, together with the practical location of the energetic sources for the treatment of the fluid substances, will be better understood from the following detailed description in which reference in made to the numeral symbols given in the figures on the accompanying drawings, outlining some of the possible applications of the process according to this invention, in which.

Figures 1, 6:
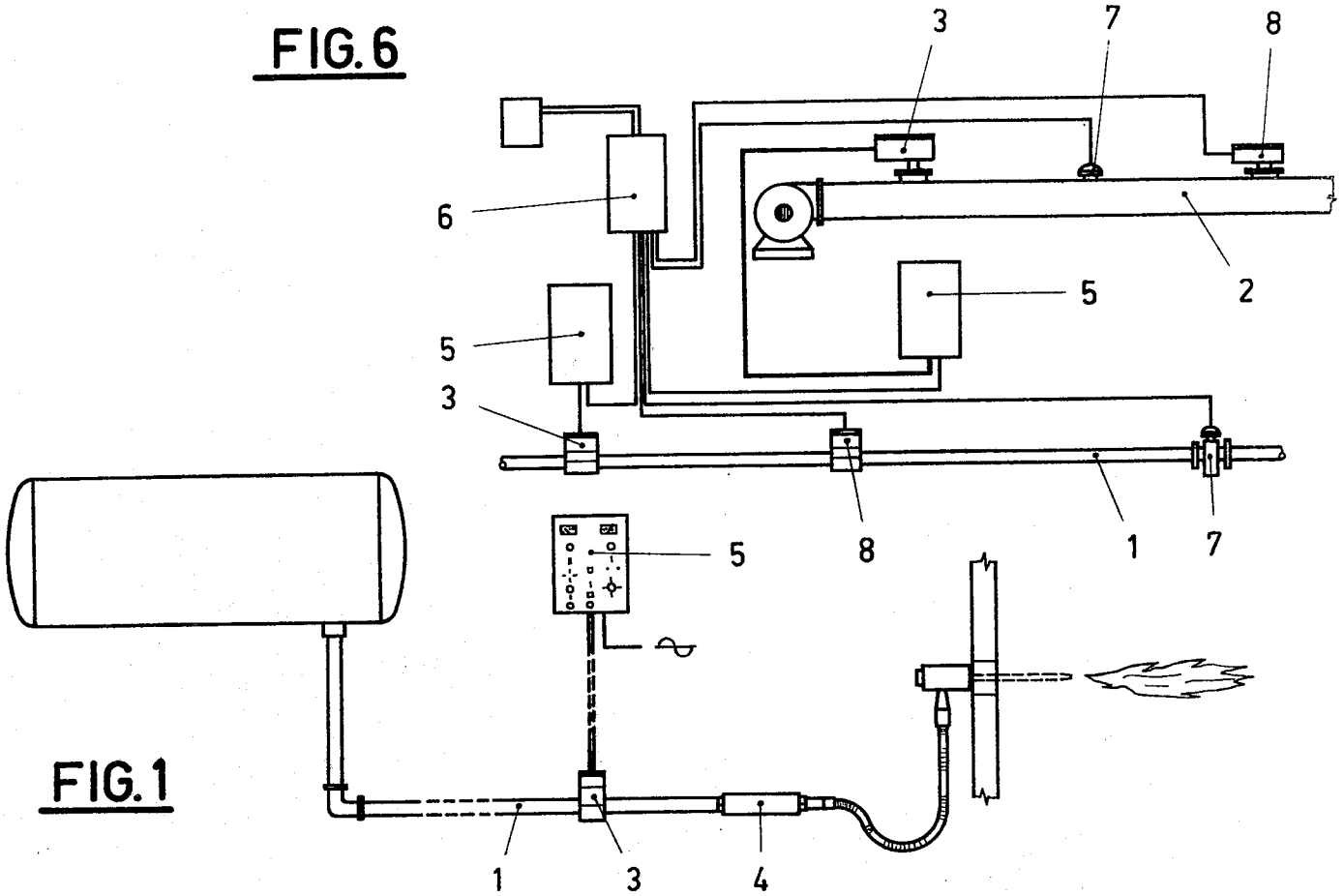
FIG. 1 represents in schematic form a burner operating with fuel oil or, more generally, with a liquid fuel.
Figures 2, 3:
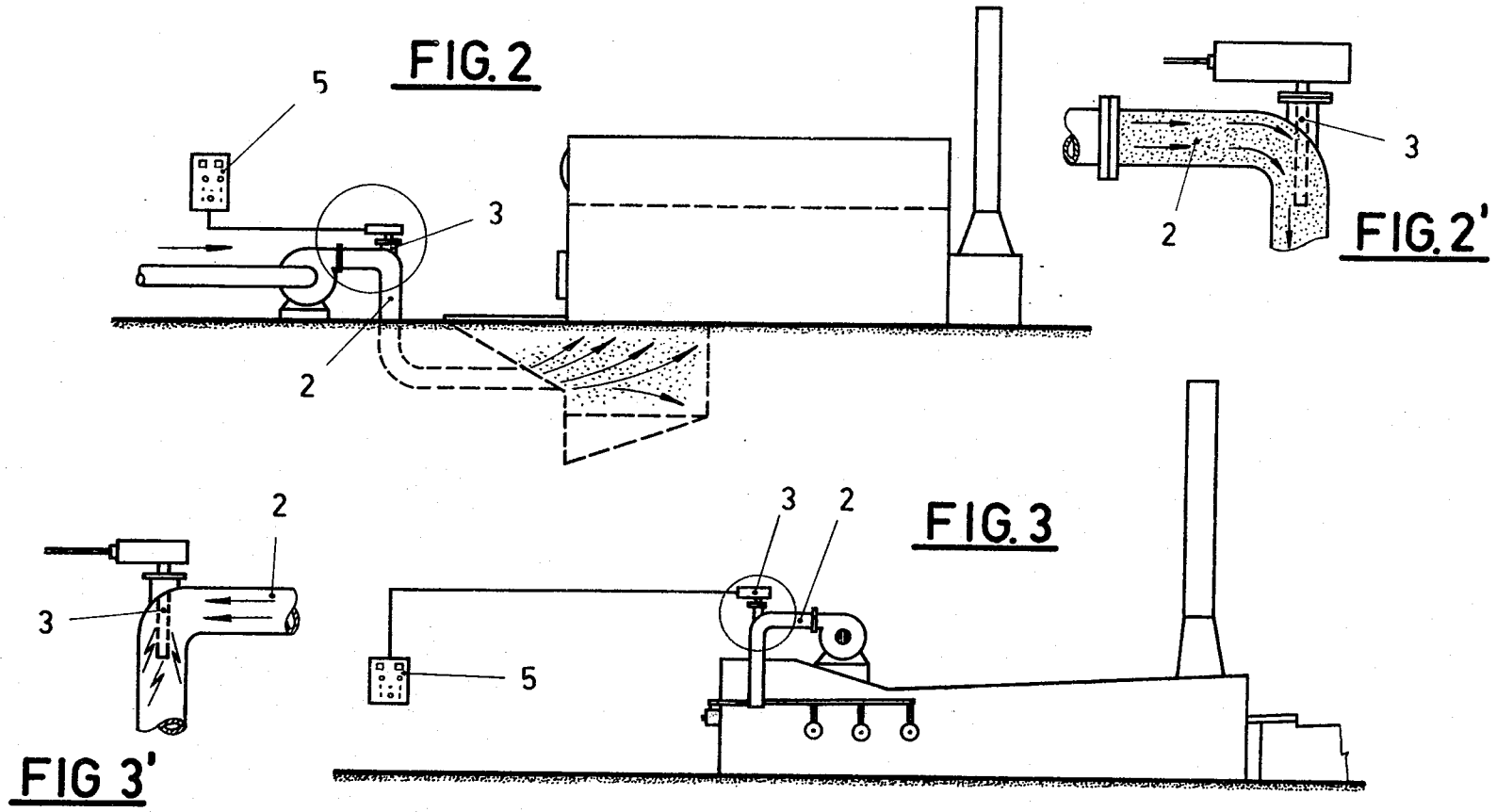
FIG. 2 shows designed in a schematic form a boiler using sawdust as fuel.

FIG. 2' represents in a schematic form a particular application of the energetic source to the boiler in FIG. 2;

FIG. 3 shows in schematic form a methane operated furnace;

FIG. 3' shows the detail of the energetic source applied on the primary air duct of the same furnace;

FIG. 4 shows designed in a schematic form a refinery smokestack;

FIG. 5 represents in schematic form a foundry cupola;

FIG. 5' shows the detail of the energetic source as applied to the supply air of the combustion in the foundry cupola in FIG. 5, and FIG. 6 schematically shows the coupling with each other of two energetic sources, applied on the combustion supporter duct and fuel duct, respectively, and automatically adjusted by a central pilot control.

Referring now particularly to the numeral symbols in the various figures on the accompanying drawing, the process of this invention provides that on the fuel flow-pipe 1 or the combustion supporter flow-pipe 2 or on both flow-pipes be applied an ultra-sound generator 3.

Said ultra-sound generator 3 should be applied upstream of the burner, namely at the point where the contact between the fuel and the combustion supporter takes place.

More accurately, should it be found advisable to carry out the treatment on the gaseous component (FIGS. 2, 3, 4 and 5), the ultra-sound generator 3 is inserted into the inside of the duct via a pipe- or blade- or grid-like sheath. The same ultra-sound generator 3 may be inserted depending on the conveniences coaxially (FIGS. 2' and 3') or perpendicularly (FIGS. 4 and 5') to the aeroform flow-pipe.

In the case instead the treatment should be carried out on the liquid component (FIG. 1), the energy is being sent perpendicularly to the ducts and the ultra-sound generator 3 is fitted on a metal block of high resonance quotient and tied onto the duct.

As metal of high resonance quotient one may advantageously use aluminium of high purity content.

The duct may be advantageously provided with a turbulence cell 4, placed downstream of the generator 3, but always before the burner. Said turbulence cell is obtained in the simplest manner by a section of the duct of larger or smaller diameter.

The ultra-sound generator 3 is supplied by an oscillator 5 of well known type.

Should the aforementioned ultra-sound generator be applied to both the fuel pipe 1 and the combustion supporter pipe 2 as shown in FIG. 6, the respective oscillators 5 may abut on a central control system 6.

Said central control system 6 processing the data transmitted by the thermocouples 7 and the signal catchers 8 being located downstream of the ultra-sound generators 3, suitably adjust the supply frequency of the generators themselves.

From the foregoing and from perusal of the various figures on the accompanying drawings appears apparent the great functional character of the process according to this invention, adapted to ensure an improved combustion of solid, liquid or gaseous substances and the practical application of the devices adapted to put the process of this invention into effect.

Said process and the devices adapted to put it into effect have been obviously described and represented by way of non-limiting embodiment example and to demonstrate its practical accomplishment and general features of this invention.

What we claim is:

1. A process for improving the combustion of a liquid fuel combustible medium in the presence of a combustion-supporting medium, comprising the steps of transporting said media to the place of combustion by conduit means; and transmitting energy pulses by resonating an aluminum sleeve having efficient resonant characteristics provided on said conduit means to at least one of said media in said conduit means at a location upstream of and remote from said place of combustion, so that the molecular attraction of said one medium is substantially reduced to facilitate mixing of said one medium with the other medium and thereby aid in combustion of the resulting mixture.

2. A process for improving combustion of a combustible medium in the presence of a combustion-supporting medium, comprising the steps of transporting said media to the place of combustion by conduit means; transmitting energy pulses to at least one of said media in said conduit means at a location upstream of and remote from said place of combustion, so that the molecular attraction of said one medium is substantially reduced to facilitate mixing of said one medium with the other medium and thereby aid in combustion of the resulting mixture; and providing sensing devices and controlling the duration of the frequency of said energy pulses in dependence upon data received from said sensing devices.

3. A process for improving the combustion of a combustible medium in the presence of a combustion-supporting medium, comprising the steps of transporting said media to the place of combustion by conduit means, said step of transporting including admitting one of said media into the presence of the other of said media at a location upstream of and remote from said place of combustion and conducting said media mixture downstream to said place of combustion; and transmitting energy pulses to at least one of said media in said conduit means at said location, so that the molecular attraction of said one medium is substantially reduced to facilitate mixing of said one medium with the other medium and thereby aid in combustion of the resulting mixture.

4. A process for improving the combustion of a combustible medium in the presence of a combustion-supporting medium, comprising the steps of transporting said media in a path to the place of combustion by conduit means; inserting a probe-like member to substantially extend into said path; and transmitting energy pulses with said probe-like member to at least one of said media in said conduit means at a location upstream of and remote from said place of combustion, so that the molecular attraction of said one medium is substantially reduced to facilitate mixing of said one medium with the other medium and thereby aid in combustion of the resulting mixture.

5. An improved combustion system, comprising a supply of a combustible medium; a supply of a combustion-supporting medium; a burner; means for transporting said media in a path to said burner; a probe-like member extending substantially into said path; and means for transmitting energy pulses with said probe-like member to at least one of said media in said transporting means at a location upstream of and remote from said burner, so that the molecular attraction of said one medium is substantially reduced to facilitate mixing of said one medium with the other medium and thereby aid in combustion of the resulting mixture.

6. A process as defined in claim 4, wherein said step of transmitting comprises subjecting said one medium to high-energy soundwaves.

7. A process as defined in claim 4, wherein said conduit means have a substantially circular cross-section and an axis, and wherein said step of transmitting includes inserting said probe colinearly with said axis of said conduit means.

8. A process as defined in claim 4, wherein said conduit means are of substantially circular cross-section and have an axis, and includes inserting said probe substantially normal to said axis of said conduit means.

9. A process as defined in claim 4, wherein said combustible medium is a liquid fuel, and wherein said step of transmitting includes resonating a metallic sleeve provided on said conduit means at said remote location.

10. A process as defined in claim 4; and further comprising the step of altering the flow rate of at least one of said media upstream of said place of combustion.

11. A process as defined in claim 4, wherein said step of transmitting is performed independently with respect to each of said media.

* * * * *